US006076759A

United States Patent [19]

Simonson

[11] Patent Number: 6,076,759

[45] Date of Patent: Jun. 20, 2000

[54] CHRISTMAS LIGHTS ORGANIZER

[76] Inventor: Perry J. Simonson, 605 Hallbrook Ct., Hermitage, Tenn. 37076

[21] Appl. No.: 09/314,914

[22] Filed: May 20, 1999

[51] Int. Cl.[7] ..... B65H 75/38

[52] U.S. Cl. ..... 242/405.3; 242/405; 242/405.1; 242/405.2; 242/587.1; 191/12.4

[58] Field of Search ..... 242/405.3, 405, 242/405.1, 405.2, 587.1; 191/12.4

[56] References Cited

U.S. PATENT DOCUMENTS

| | | | |
|---|---|---|---|
| D. 251,356 | 3/1979 | Bogaert | D8/358 |
| D. 322,552 | 12/1991 | Lebon | 242/405.3 X |
| 2,133,337 | 10/1938 | Zvanut | 242/405.3 |
| 2,572,417 | 10/1951 | Wolk | 242/405.3 X |
| 4,123,012 | 10/1978 | Hough | 242/405.2 |
| 4,981,271 | 1/1991 | Carter | 242/405.3 |
| 5,064,067 | 11/1991 | McAllister et al. | 206/420 |
| 5,139,208 | 8/1992 | Schooley | 242/405.2 |
| 5,458,241 | 10/1995 | Brown | 242/405.2 X |
| 5,819,894 | 10/1998 | Okamoto | 191/12.4 |

FOREIGN PATENT DOCUMENTS

| | | | |
|---|---|---|---|
| 788379 | 10/1935 | France | 242/405.1 |

*Primary Examiner*—Donald P. Walsh
*Assistant Examiner*—Minh-Chau Pham

[57] ABSTRACT

A Christmas lights organizer for reeling an elongate flexible element, such as a string of Christmas lights, therearound. The Christmas lights organizer includes a spaced apart pair of panels with a spaced apart pair of inner rods extending therebetween. Each of the panels has an elongate outer rod outwardly extending therefrom. A first of the outer rods is coaxial with a first of the inner rods and a second of the outer rods is coaxial with a second of the inner rods. The first inner rod has a spaced apart pair of slots therein designed for receiving the prongs of an electrical plug therein.

6 Claims, 2 Drawing Sheets

CHRISTMAS LIGHTS ORGANIZER

BACKGROUND OF THE INVENTION

1. Field of the Invention

The present invention relates to Christmas lights organizers and more particularly pertains to a new Christmas lights organizer for reeling an elongate flexible element, such as a string of Christmas lights, therearound.

2. Description of the Prior Art

The use of Christmas lights organizers is known in the prior art. More specifically, Christmas lights organizers heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,526,931; U.S. Pat. No. 5,064,067; U.S. Pat. No. 2,287,368; U.S. Pat. No. Des. 198,981; U.S. Pat. No. 4,501,567; and U.S. Pat. No. Des. 251,356.

While these devices fulfill their respective, particular objectives and requirements, the aforementioned patents do not disclose a new Christmas lights organizer. The inventive device includes a spaced apart pair of panels with a spaced apart pair of inner rods extending therebetween. Each of the panels has an elongate outer rod outwardly extending therefrom. A first of the outer rods is coaxial with a first of the inner rods and a second of the outer rods is coaxial with a second of the inner rods. The first inner rod has a spaced apart pair of slots therein designed for receiving the prongs of an electrical plug therein.

In these respects, the Christmas lights organizer according to the present invention substantially departs from the conventional concepts and designs of the prior art, and in so doing provides an apparatus primarily developed for the purpose of reeling an elongate flexible element, such as a string of Christmas lights, therearound.

SUMMARY OF THE INVENTION

In view of the foregoing disadvantages inherent in the known types of Christmas lights organizers now present in the prior art, the present invention provides a new Christmas lights organizer construction wherein the same can be utilized for reeling an elongate flexible element, such as a string of Christmas lights, therearound.

The general purpose of the present invention, which will be described subsequently in greater detail, is to provide a new Christmas lights organizer apparatus and method which has many of the advantages of the Christmas lights organizers mentioned heretofore and many novel features that result in a new Christmas lights organizer which is not anticipated, rendered obvious, suggested, or even implied by any of the prior art Christmas lights organizers, either alone or in any combination thereof.

To attain this, the present invention generally comprises a spaced apart pair of panels with a spaced apart pair of inner rods extending therebetween. Each of the panels has an elongate outer rod outwardly extending therefrom. A first of the outer rods is coaxial with a first of the inner rods and a second of the outer rods is coaxial with a second of the inner rods. The first inner rod has a spaced apart pair of slots therein designed for receiving the prongs of an electrical plug therein.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Christmas lights organizer apparatus and method which has many of the advantages of the Christmas lights organizers mentioned heretofore and many novel features that result in a new Christmas lights organizer which is not anticipated, rendered obvious, suggested, or even implied by any of the prior art Christmas lights organizers, either alone or in any combination thereof.

It is another object of the present invention to provide a new Christmas lights organizer which may be easily and efficiently manufactured and marketed.

It is a further object of the present invention to provide a new Christmas lights organizer which is of a durable and reliable construction.

An even further object of the present invention is to provide a new Christmas lights organizer which is susceptible of a low cost of manufacture with regard to both materials and labor, and which accordingly is then susceptible of low prices of sale to the consuming public, thereby making such Christmas lights organizer economically available to the buying public.

Still yet another object of the present invention is to provide a new Christmas lights organizer which provides in the apparatuses and methods of the prior art some of the advantages thereof, while simultaneously overcoming some of the disadvantages normally associated therewith.

Still another object of the present invention is to provide a new Christmas lights organizer for reeling an elongate flexible element, such as a string of Christmas lights, therearound.

Yet another object of the present invention is to provide a new Christmas lights organizer which includes a spaced apart pair of panels with a spaced apart pair of inner rods extending therebetween. Each of the panels has an elongate outer rod outwardly extending therefrom. A first of the outer rods is coaxial with a first of the inner rods and a second of the outer rods is coaxial with a second of the inner rods. The first inner rod has a spaced apart pair of slots therein designed for receiving the prongs of an electrical plug therein.

Still yet another object of the present invention is to provide a new Christmas lights organizer that allows a user to store Christmas light strings in an organized manner.

Even still another object of the present invention is to provide a new Christmas lights organizer that may also be used with electrical extension cords.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
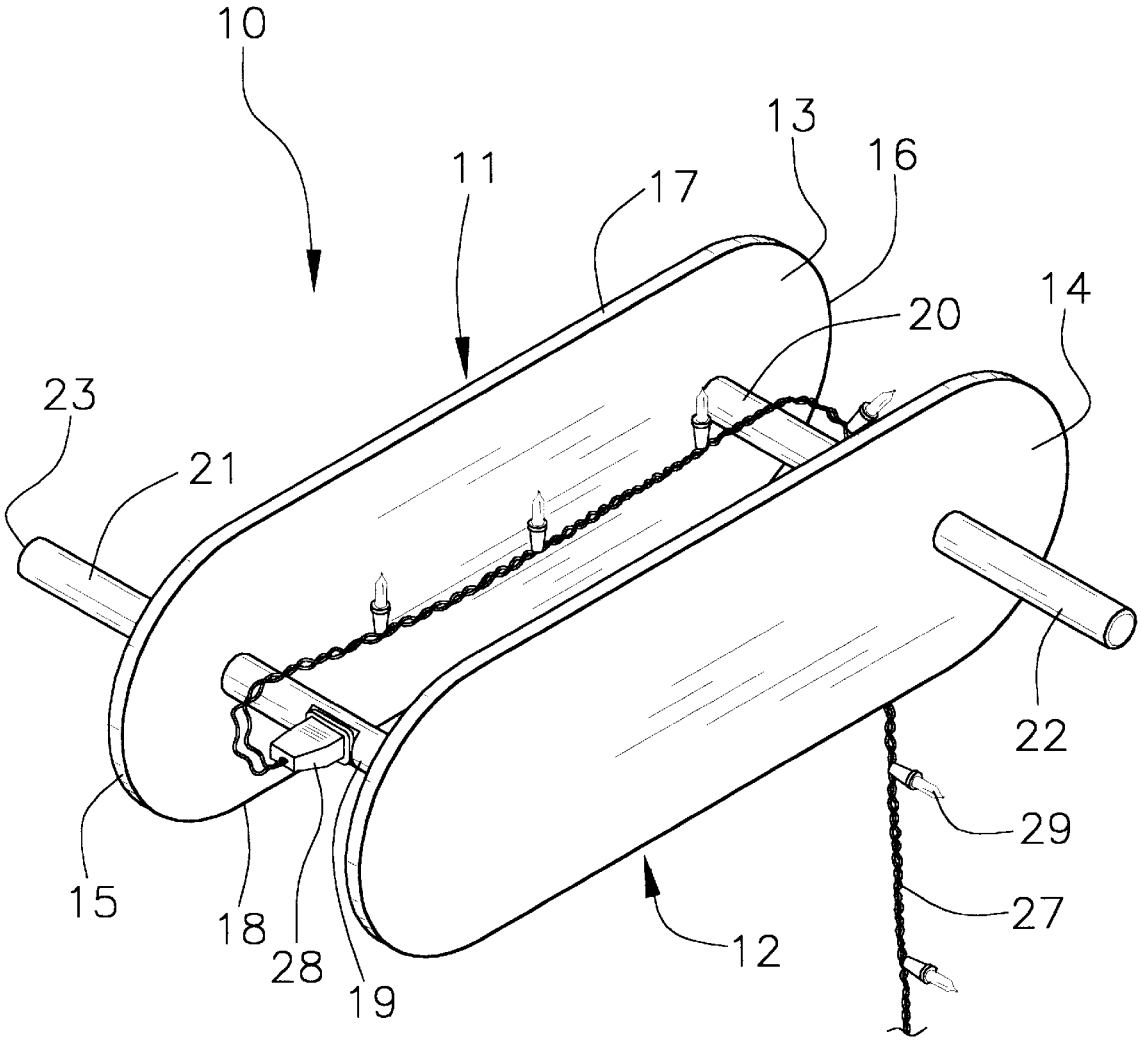
FIG. 1 is a schematic perspective view of a new Christmas lights organizer in use according to the present invention.
Figure 2:
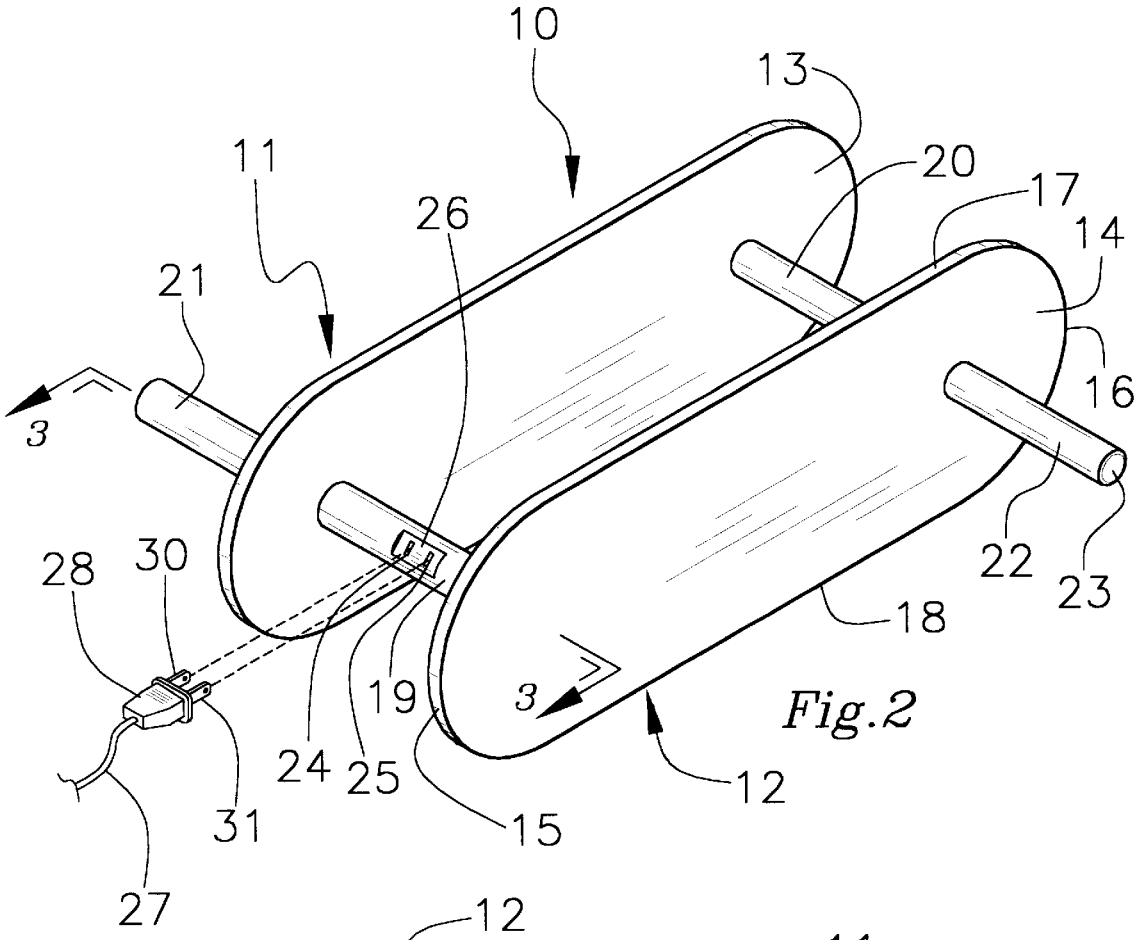
FIG. 2 is a schematic perspective view of the present invention.
Figure 3:
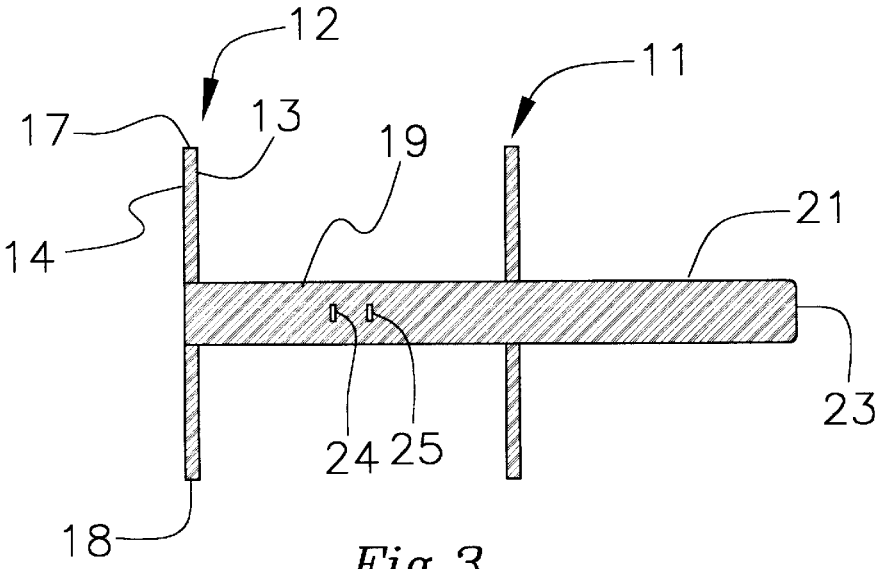
FIG. 3 is a schematic cross sectional view of the present invention taken from line 3-3 of FIG. 2.

With reference now to the drawings, and in particular to FIGS. 1 through 3 thereof, a new Christmas lights organizer embodying the principles and concepts of the present invention and generally designated by the reference numeral 10 will be described.

As best illustrated in FIGS. 1 through 3, the Christmas lights organizer 10 generally comprises a spaced apart pair of panels with a spaced apart pair of inner rods extending therebetween. Each of the panels has an elongate outer rod outwardly extending therefrom. A first of the outer rods is coaxial with a first of the inner rods and a second of the outer rods is coaxial with a second of the inner rods. The first inner rod has a spaced apart pair of slots therein designed for receiving the prongs of an electrical plug therein.

In closer detail, the organizer 10 comprises a spaced apart pair of equal sized generally oblong planar panels 11,12 lying in substantially parallel planes with one another. Each of the panels has substantially planar inner and outer faces 13,14 with the inner faces of the panels facing one another. The panels each also have an outer perimeter comprising a pair of opposite generally semi-circular arcuate ends 15,16, and a pair of substantially straight and parallel sides 17,18 extending between the ends of the respective panel.

The arcuate ends of the panels each have a radius of curvature defining (on the respective panel) a center of curvature of the respective arcuate end from which the radius of curvature outwardly radiates. Preferably, the arcuate ends of the panels preferably have equal radii of curvatures. The center of curvature of a first of the arcuate ends of a first of the panels is coaxially aligned with the center of curvature of a first of the arcuate ends of a second of the panels. Similarly, the center of curvature of a second of the arcuate ends of first panel is coaxially aligned with the center of curvature of a second of the arcuate ends of the second panel.

A spaced apart pair of preferably equal sized and substantially parallel elongate inner rods 19,20 are extended between and preferably integrally coupled to the inner faces of the panels. The inner rods have substantially parallel longitudinal axes extending substantially perpendicular to the planes of the panels. Each of the inner rods preferably has a generally circular transverse cross section taken substantially perpendicular to the longitudinal axis of the respective inner rod to make it easier to wrap elongate flexible elements therearound.

The longitudinal axis of a first of the inner rods is coaxially aligned with the centers of curvature of the first arcuate ends of the panels. The longitudinal axis of a second of the inner rods is coaxially aligned with the centers of curvature of the second arcuate ends of the panels.

The outer faces of the panels each have an elongate outer rod 21,22 outwardly extending therefrom such that a first of the outer rods outwardly extends from the outer face of the first panel and a second of the outer rod outwardly extends from the outer face of the second panel. Each of the outer rods has a longitudinal axis extending substantially perpendicular to the associated panel and terminating at a free outer end 23. Like the inner rods, preferably, each of the outer rods has a generally circular transverse cross section taken substantially perpendicular to the longitudinal axis of the respective outer rod.

The longitudinal axis of the first outer rod is coaxially aligned with the centers of curvature of the first arcuate ends of the panels and the first inner rod. The longitudinal axis of the second outer rod is coaxially aligned with the centers of curvature of the second arcuate ends of the panels and the second inner rod.

The first inner rod has a spaced apart pair of substantially parallel slots 24,25 therein designed for receiving the prongs of an electrical plug therein. The slots of the first inner rod preferably face outwardly away from the second inner rod. In a preferred embodiment, the first inner rod may also have a generally rectangular depression 26 therein in which the slots are located. The depression faces outwardly away from the second inner rod like the slots. Ideally, the depression lies in a plane extending at an acute angle to the sides of the panels and substantially perpendicular to the inner faces of the panels. In use, the depression is designed for receiving the end of a plug whose prongs are inserted into the slots.

In an ideal illustrative embodiment, each of the panels has a length defined between the arcuate ends of the respective panel of about 12 inches, and a width defined between the sides of the respective panel of about 6 inches. In this ideal illustrative embodiment, each of the inner rods has a length defined between the inner faces of the panels of about 6 inches and the outer rods each have a length defined outwardly from the outer face of the associated panel of about 5 inches.

In use, the organizer is designed for wrapping an elongate flexible element 27 such as a string of Christmas lights (or an electric extension cord). Specifically, the flexible elements has a plug 28 at an end of the flexible element electrically connected to the lights 29 of the string. The plug has a pair of prongs 30,31 extending therefrom to permit electrically connecting the lights to a receptacle of an electric power source. The prongs of the plug are inserted into the slots of the first inner rod such that the end of the plug is extended into the depression. The flexible element is then wrapped around the inner rods by a user grasping the outer rods with their hands and rotating the organizer about a center axis of rotation between longitudinal axes of the inner and outer rods to form the flexible element into a coil about the inner rods between the panels.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An elongate flexible element organizer, comprising:

a spaced apart pair of panels;

a spaced apart pair of inner rods being extended between said panels;

each of said panels having an elongate outer rod outwardly extending therefrom, a first of said outer rods being coaxial with a first of said inner rods and a second of said outer rods being coaxial with a second of said inner rods; and said first inner rod having a spaced apart pair of slots therein adapted for receiving the prongs of an electrical plug therein.

2. The elongate flexible element organizer of claim 1, wherein each of said panels has substantially planar inner and outer faces and an outer perimeter comprising a pair of opposite generally semi-circular arcuate ends, and a pair of substantially straight and parallel sides extending between said ends of the respective panel, wherein said inner faces of said panels face one another.

3. The elongate flexible element organizer of claim 2, wherein said arcuate ends of said panels each have a radius of curvature defining a center of curvature of the respective arcuate end, wherein said center of curvature of a first of said arcuate ends of said first panel being coaxially aligned with said center of curvature of a first of said arcuate ends of said second panel, and wherein said center of curvature of a second of said arcuate ends of said first panel is coaxially aligned with said center of curvature of a second of said arcuate ends of said second of said panels.

4. The elongate flexible element organizer of claim 3, wherein a longitudinal axis of said first inner rod is coaxially aligned with said centers of curvature of said first arcuate ends of said panels, and wherein a longitudinal axis of said second inner rod is coaxially aligned with said centers of curvature of said second arcuate ends of said panels.

5. The elongate flexible element organizer of claim 1, wherein said first inner rod has a depression, and wherein said slots are located in said depression.

6. An elongate flexible element organizer system, comprising:

a spaced apart pair of generally oblong planar panels lying in substantially parallel planes with one another;

each of said panels having substantially planar inner and outer faces and an outer perimeter comprising a pair of opposite generally semi-circular arcuate ends and a pair of substantially straight and parallel sides extending between said ends of the respective panel;

said inner faces of said panels facing one another;

said arcuate ends of said panels each having a radius of curvature defining a center of curvature of the respective arcuate end;

said center of curvature of a first of said arcuate ends of a first of said panels being coaxially aligned with said center of curvature of a first of said arcuate ends of a second of said panels said center of curvature of a second of said arcuate ends of said first panel being coaxially aligned with said center of curvature of a second of said arcuate ends of said second panel;

a spaced apart pair of substantially parallel elongate inner rods being extended between said inner faces of said panels;

said inner rods having substantially parallel longitudinal axes extending substantially perpendicular to said planes of said panels;

each of said inner rods having a generally circular transverse cross section taken substantially perpendicular to said longitudinal axis of the respective inner rod; said longitudinal axis of a first of said inner rods being coaxially aligned with said centers of curvature of said first arcuate ends of said panels;

said longitudinal axis of a second of said inner rods being coaxially aligned with said centers of curvature of said second arcuate ends of said panels;

said outer faces of said panels each having an elongate outer rod outwardly extending therefrom such that a first of said outer rods outwardly extends from said outer face of said first panel and a second of said outer rod outwardly extends from said outer face of said second panel;

each of said outer rods having a longitudinal axis extending substantially perpendicular to the associated panel;

each of said outer rods having a generally circular transverse cross section taken substantially perpendicular to said longitudinal axis of the respective outer rod;

said longitudinal axis of said first outer rod being coaxially aligned with said centers of curvature of said first arcuate ends of said panels and said first inner rod;

said longitudinal axis of said second outer rod being coaxially aligned with said centers of curvature of said second arcuate ends of said panels and said second inner rod;

said first inner rod having a spaced apart pair of substantially parallel slots therein;

said slots of said first inner rod facing outwardly away from said second inner rod;

said first inner rod having a generally rectangular depression therein facing outwardly away from said second inner rod;

said depression lying in a plane extending at an acute angle to said sides of said panels and substantially perpendicular to said inner faces of said panels;

said slots being located in said depression;

an elongate flexible element having a plug at an end of said flexible element, said plug having a pair of prongs extending therefrom;

said prongs of said plug being inserted into said slots of said first inner rod; and said flexible element being wrapped around said inner rods to form said flexible element into a coil about said inner rods between said panels.

* * * * *